US006530465B1

(12) United States Patent
Lauch

(10) Patent No.: US 6,530,465 B1
(45) Date of Patent: Mar. 11, 2003

(54) ILLUMINATED ESCALATOR COMBPLATE

(75) Inventor: Richard Lauch, Hopatcong, NJ (US)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/124,187

(22) Filed: Apr. 17, 2002

(51) Int. Cl.[7] ..... B22B 29/08
(52) U.S. Cl. ..... 198/325
(58) Field of Search ..... 198/324, 325

(56) References Cited

U.S. PATENT DOCUMENTS 4,756,398 A * 7/1988 Watanabe et al. ..... 198/324
5,613,758 A * 3/1997 Kamschal et al. ..... 362/576

FOREIGN PATENT DOCUMENTS

EP 1157958 A1 * 11/2001 ..... B66B/29/06
JP 03293288 A * 12/1991 ..... B66B/23/08
JP 05058579 A * 3/1993 ..... B66B/29/06
JP 10045363 A * 2/1998 ..... B66B/23/12

* cited by examiner

*Primary Examiner*—Christopher P. Ellis
*Assistant Examiner*—Mark A. Deuble
(74) *Attorney, Agent, or Firm*—Schweitzer Cornman Grosss & Bondell LLP

(57) ABSTRACT

An illuminated escalator combplate has a main combplate portion and a combteeth element extending forwardly of the main portion. A series of light emitters are mounted to a forward edge of the main portion, and are aligned with a corresponding series of light pipes in the combteeth element which channel the light of the emitters from a rearward wall adjacent the main portion forward edge to an upper surface of the combteeth element where the light can be seen by escalator users and serves as a safety indicator to demarcate the intersection between the fixed combplate and the moving escalator step plates. The light emitter may be in alternately-illuminated, interleaved gangs to increase visability.

10 Claims, 1 Drawing Sheet

FIG. 1
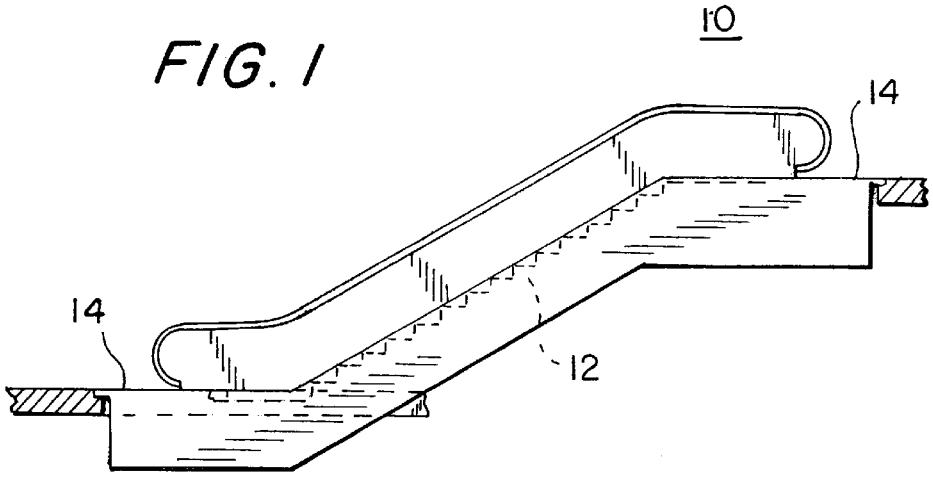
FIG. 2
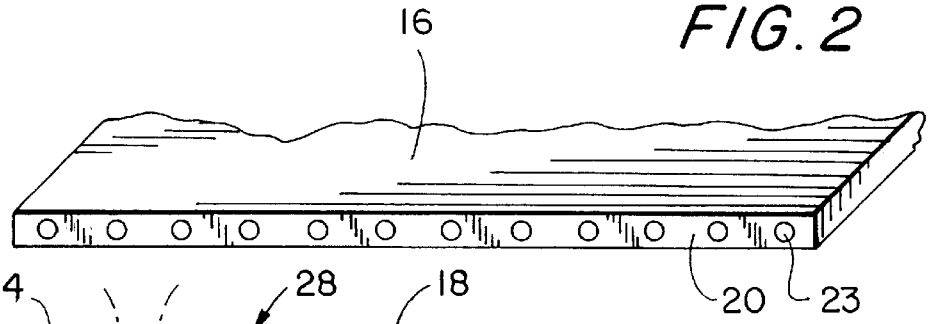
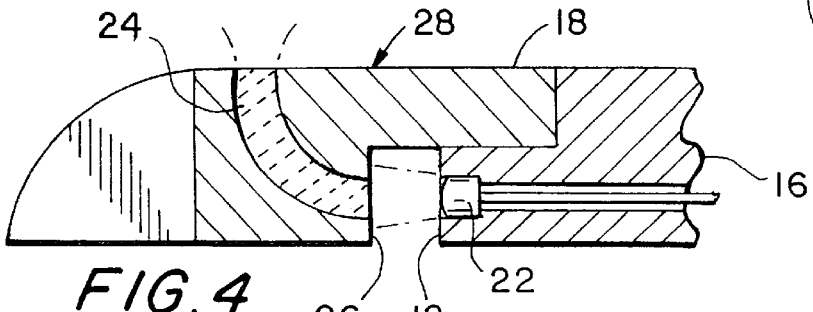
FIG. 4
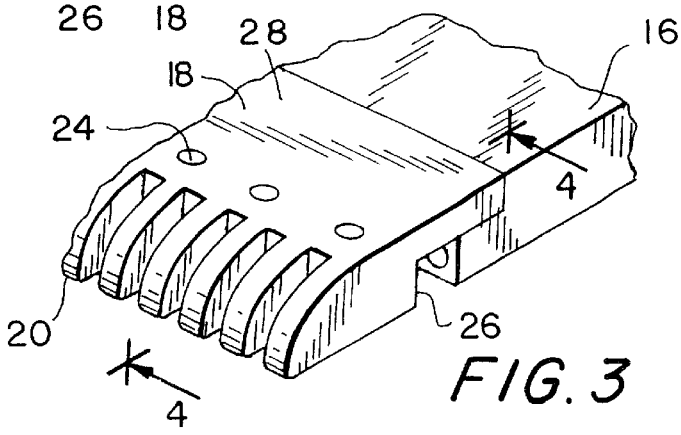
FIG. 3

ILLUMINATED ESCALATOR COMBPLATE

The present invention relates to a new and improved apparatus for providing improved visibility to escalator surfaces and particularly to an escalator combplate.

BACKGROUND OF THE INVENTION

The act of entering and exiting an escalator can be of difficulty, particularly to the aged and infirm. Some of this difficulty can be attributed to a difficulty in perceiving the line of demarcation between the fixed step plate of the escalator and the continuously moving step system.

The prior art teaches that an escalator combplate, which is that portion of the fixed step area which interacts with the moving steps, be provided with illumination to assist in identifying and delineating the combplate. Published European Patent Application 1 157 958 discloses an elevator combplate having a series of light-emitting diodes located behind a translucent comb. Because the light emitters are mounted vertically with in the combplate, they must be of small dimension. Further, their mounting position provides limited area for interconnection. Also, their position subjects them to increased potential for damage.

It is accordingly a purpose of the present invention to provide a new and improved illumination means for a combplate having increased durability and flexibility.

BRIEF DESCRIPTION OF THE INVENTION

In accordance with the foregoing and other purposes, objects and benefits, a combteeth illumination apparatus of the present invention comprises a series of spaced illumination means mounted to a forward edge of a main combplate element. A forward combteeth element, which engages with the escalator step, is provided with a plurality of light pipes extending between a first surface positioned adjacent the light-emitting means and a second end located on a common exposed surface of the combteeth element. The light pipes transmit light generated by the light emitters to the upper surface. The light emitters may be ganged into sets that may be alternately illuminated, the alternate illumination being able to be perceived at the combplate surface. The light emitters are activated whenever the escalator is operating.

BRIEF DESCRIPTION OF THE DRAWINGS

A fuller understanding of the present invention will be accomplished upon consideration of the following detailed disclosure of a preferred, but nonetheless illustrative embodiment of the invention, when reviewed in connection with the annexed drawings, wherein:

FIG. 1 is an elevation view of an escalator employing the present invention;

FIG. 2 is a perspective view of a forward edge of the main portion of the escalator combplate bearing the light-emitting means;

FIG. 3 is a perspective view of a portion of the forward end of the combplate showing the forward combteeth element and the forward edge of the combplate main portion; and FIG. 4 is a partial section view taken along line 4—4 of FIG. 3.

DETAILED DESCRIPTION OF THE INVENTION

As seen in FIG. 1, escalator 10 includes an endless step loop 12 of interconnected step plates driven by appropriate machinery (not shown). At the top and bottom of the step loop combplate units 14 are provided, and form the entrance and exit platforms from which the users step onto and off of the escalator step plates. As conventional escalator constructions typically utilize step plates that are of a laterally-grooved configuration, the combplates 14 typically include a serrated or grooved forward portion which mates with the corresponding grooves or serrations in the step plates and provides a continuous step surface and transition between the step plate and combplate.

As shown in FIG. 3, the combplate in which the present invention is employed includes a main combplate portion 16 and a forward combteeth element 16, which bears the serrations 20 to mate with the grooves on the step plates. The forward combteeth plate portion 18 may be either rigidly or pivotly affixed to the main combplate 16, in manners known in the art. While not shown, both the forward combteeth element as well as the main combplate portion may be grooved or serrated along their top surfaces in a manner complementary to the grooves in the step plates and to provide an improved footing surface for the user.

As seen in FIG. 2, forward edge 20 of main combplate portion 16 is provided with a plurality of light-generating means 22 in appropriately dimensioned accepting bores. The light-emitting means 22 may comprise a series of light-emitting diodes (LEDs). Preferably, the light emitters 22 are in a spaced relationship along substantially the full width of the main combplate portion 16. The front surfaces of the emitters 22 are preferably flush with the forward edge 20. The main combplate portion 16 may be provided with appropriate internal channels or cavities (not shown) to accommodate the leads of the light emitters 20 and couple them to an appropriate drive circuit, also not shown.

Forward combteeth element 18 is provided with a plurality of light pipes 24 running from the rear vertical edge 26 of the element which is adjacent to the forward edge 20 of main combplate portion 16 to an upper surface 28 of the element, such that the light transmitted thereby can be seen by users of the escalator. Preferably, the light pipes 24 comprise a series of passageways or bores through the combteeth element, each of which is aligned with a corresponding one of the light emitters 22. The bores are filled with an appropriate light-transmitting compound or structure, such as an epoxy or polymer resin or a fiber optic bundle, chosen to transmit the light through the light pipe with minimal losses. In a preferred embodiment, a polymer compound is utilized, the end surfaces thereof being finished to be flush with the adjacent vertical and top surfaces 26, 28 of the combteeth element 18. The polymer can be either transparent or translucent, colorless or tinted.

In operation, the light emitters 22 are preferably wired into at least two interleaved emitter groups, and are connected to drive circuitry that alternately illuminate the groups on a continuous basis. The light generated by the emitters is transmitted by the light pipes 24 to the upper surface of the combteeth element, where the alternating lights may be easily seen by the escalator user, whose attention is thus drawn to the forward end of the combplate and thus the intersection between the combplate and the moving escalator steps.

I claim:

1. An illuminated escalator combplate, comprising:

a main combplate portion having a depending front edge;

light emitting means located along the front edge;

a combteeth element extending forwardly from the main combplate element; and light guide means in the combteeth element for directing light emitted by the light emitters to an upper surface of the combteeth element where the light can be seen by users of the escalator.

2. The combplate of claim 1 wherein the light emitting means comprise a series of light emitters.

3. The combplate of claim 1 wherein the light emitters are light emitting diodes.

4. The combplate of claim 3 wherein the light emitting diodes are mounted in bores in the front edge and have front faces flush with the front edge.

5. The combplate of claim 1, 2, or 3 wherein the light guide means extend between a vertical rear-facing surface of the combteeth element and the upper surface.

6. The combplate of claim 1, 2, or 3 wherein the light guide means are a series of channels bearing a light-transmissive element.

7. The combplate of claim 6, wherein the light-transmissive element is a transparent or translucent polymer.

8. The combplate of claim 7, wherein the polymer is tinted.

9. The combplate of claim 1, 2, or 3 wherein the light emitting means comprise at least two groups, each group being able to be illuminated independently.

10. The combplate of claim 9 wherein the light emitting means of the groups are interleaved along the front edge.

* * * * *